United States Patent [19]

Griffing et al.

[11] Patent Number: 4,761,178

[45] Date of Patent: Aug. 2, 1988

[54] PROCESS FOR HEATING MOLTEN STEEL CONTAINED IN A LADLE

[75] Inventors: Neal R. Griffing, Bethlehem; Marvin H. Bayerwitz, Allentown; Philip D. Stelts, Center Valley, all of Pa.

[73] Assignee: Bethlehem Steel Corporation, Bethlehem, Pa.

[21] Appl. No.: 88,443

[22] Filed: Aug. 24, 1987

[51] Int. Cl.[4] ..... C21C 7/00

[52] U.S. Cl. ..... 75/51.2

[58] Field of Search ..... 75/51.2, 51.3, 49

[56] References Cited

U.S. PATENT DOCUMENTS

| | | | |
|---|---|---|---|
| 2,557,458 | 6/1951 | Ogan | 420/103 |
| 2,662,819 | 12/1953 | Hofges | 420/103 |
| 3,645,520 | 2/1972 | Acre et al. | 266/225 |
| 4,187,102 | 2/1980 | Choulet et al. | 75/51.2 |
| 4,200,452 | 4/1980 | Savov | 75/49 |
| 4,278,464 | 7/1981 | Bury et al. | 75/51.2 |
| 4,518,422 | 5/1985 | Metz | 75/58 |
| 4,537,629 | 8/1985 | Lazcano-Navarro | 75/51.2 |

FOREIGN PATENT DOCUMENTS 59-89708 5/1984 Japan .

*Primary Examiner*—Peter D. Rosenberg
*Attorney, Agent, or Firm*—John I. Iverson

[57] ABSTRACT

The temperature of molten steel in a ladle is raised to a predetermined level by introducing a plurality of oxygen containing gas streams beneath the surface of molten steel and introducing a predetermined quantity of an oxidizable fuel, such as aluminum or silicon, into the molten steel.

7 Claims, 1 Drawing Sheet

PROCESS FOR HEATING MOLTEN STEEL CONTAINED IN A LADLE

BACKGROUND OF THE INVENTION

This invention relates to a method for controlling the temperature of molten steel in a transfer ladle or similar vessel. It relates particularly to a method by which the molten steel can be heated in a transfer ladle after the steel has been tapped from a steelmaking furnace.

In the conventional steelmaking processes, molten iron and scrap are refined into steel in a basic oxygen furnace or an electric arc furnace. The molten steel is then tapped into a refractory lined ladle for further treatment of the molten steel and transfer. The steel is then poured into the ladle into a continuous caster or into ingot molds. It is critical in the continuous casting of steel that steel be at the proper temperature when it is poured into the continuous caster. Often, due to production delays, the ladle of molten steel arrives at the continuous caster at a temperature lower than that required. Unless the temperature of the steel can be raised to the desired temperature for continuous casting, the ladle of steel must be diverted away from the continuous caster and the cooled steel is then poured into ingot molds. Such a diversion of the ladle of steel often requires a shutdown of the caster which decreases production rates and raises costs.

Many steelmakers try to reduce the risk of the molten steel being too cold when it reaches the continuous caster by tapping the steel into the ladle from the refining furnace at a temperature much hotter than normal. This practice increases the furnace refining costs and reduces the life of the refractories in the refining furnace and ladles.

Other steelmakers have attempted to supply additional heat to the molten steel in the ladle by the use of electrical heaters or fuel fired burners that fit over the ladle. The capital and operating costs of such auxiliary heating systems have been quite high.

Another approach tried by a few steelmakers to add heat to molten steel has been to add materials to the steel which when combined produce an exothermic chemical reaction. Examples of such practices are described in U.S. Pat. Nos. 2,557,458; 4,187,102; 4,278,464 and Japanese Pat. No. 59-89708 (1984). In the practices described in the above-noted U.S. patents, aluminum or silicon and oxygen are simultaneously added to the molten steel in the refining furnace which when combined produce a violent exothermic chemical reaction which raises the temperature of the steel. The enclosed refining ladle restrains the splash and slopping resulting from the violent exothermic chemical reaction. The refining ladle also contains a slag to capture the large amounts of aluminum or silicon oxides produced by the aluminum or silicon additions.

When the chemical reaction practice for heating steel was applied to steel in a ladle, such as described in the above-noted Japanese Pat. No. 59-89708 (1984), it required oversized ladles with extra freeboard to contain the splash and turbulence or alternatively a shallow oxygen lance with an inert stirring gas injected through a porous brick or tuyere in the bottom of the ladle directly below the oxygen lance to prevent excessive turbulence and splashing. Such a practice requires ladles equipped with porous bricks or tuyeres in the bottom which are fitted with gas conduits. Porous bricks and tuyeres have been known to fail unexpectedly and permit the leakage of molten steel from the ladle thereby causing a potential safety problem. In addition, there is a considerable expense required to install, maintain and operate the inert gas system and porous brick or tuyere described in Japanese Pat. No. 59-89708. The Japanese practice also requires the inert stirring gas injected through the ladle bottom to distribute the aluminum or silicon uniformly throughout the molten steel before the oxygen is injected.

SUMMARY OF THE INVENTION

It is an object of this invention to provide a method for heating molten steel in a transfer ladle or similar vessel.

It is a further object of this invention to provide a method for heating molten steel in a ladle that does not require structural modifications to the bottom of the ladle.

It is a still further object of this invention to provide a method for accurately controlling the temperature of molten steel in a transfer ladle prior to continuous casting.

It is another object of the invention to provide a method for heating molten steel in a ladle which does not result in large amounts of detrimental aluminum or silicon oxide inclusions in the continuous cast steel.

It is another object of this invention to provide a safe, effective, low cost method to heat molten steel in a ladle that can be easily adapted to standard transfer ladles and to most of the existing continuous casting facilities.

It has been discovered that the foregoing objectives can be attained by a process for heating the molten steel contained in a ladle by introducing a plurality of oxygen containing gas streams beneath the surface of the molten steel and introducing a quantity of an oxidizable fuel, such as aluminum or silicon, to the molten steel sufficient so that the oxidation thereof by the oxygen containing gas streams raises the temperature of the molten steel in the ladle to a predetermined level.

DESCRIPTION OF A PREFERRED EMBODIMENT

Figure 1:
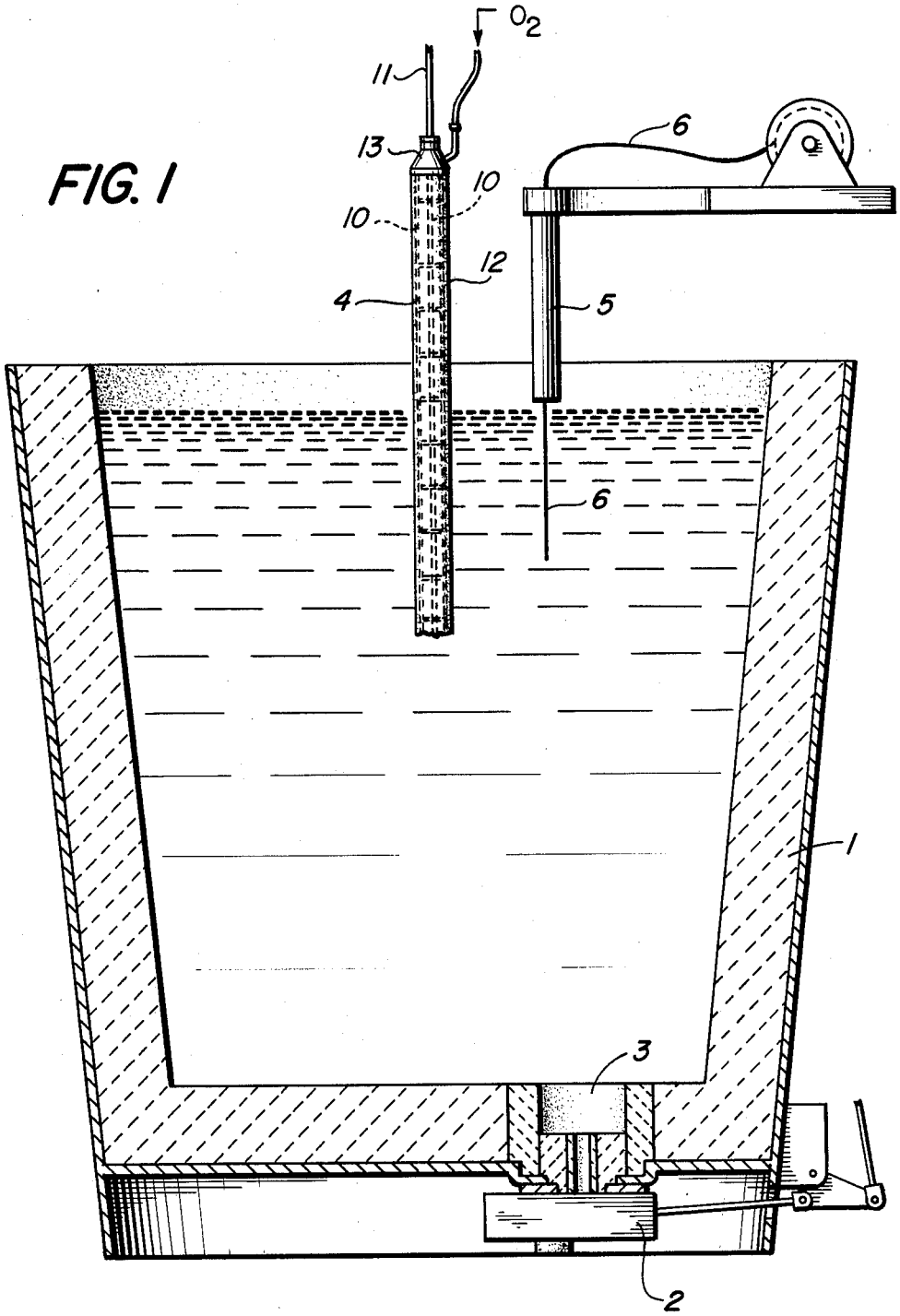
FIG. 1 is a sectional view of a steel transfer ladle illustrating the apparatus used in the process of this invention.

FIG. 1 illustrates a preferred embodiment of the apparatus used to practice the process of this invention. Ladle 1 is a conventional refractory lined ladle used by steelmakers to move molten steel by crane to various locations. Ladle 1 is equipped with a slide gate valve 2 under ladle nozzle 3 to control the discharge of molten steel from the ladle 1. While the ladle 1 is the preferred vessel to contain the molten steel while being reheated, other refractory lined vessels could be used also.

A consumable lance 4 used to introduce gaseous oxygen is positioned over the ladle 1 by a crane (not shown) in the approximate center of the ladle 1. The immersion depth of the lance 4 should be maintained between 15% and 40% of the depth of the molten steel in the ladle, preferably about 30% of the depth. A second nonconsumable lance fuel feeder 5 is positioned above and to one side of the ladle 1 as shown in FIG. 1 and is used to introduce into the molten steel in ladle 1 a controllable quantity of an oxidizable fuel, such as aluminum, in the form of a wire 6. The fuel could also be added in other forms such as lumps, rods or pellets. The fuel is introduced as close as practical to the point at which the oxygen is added.

The method of this invention consists essentially of (1) ensuring that sufficient oxidizable fuel is always present in the molten steel, (2) introducing a plurality of oxygen containing gas streams beneath the surface of the molten steel in sufficient quantities to fully react with the fuel and generate sufficient heat in the molten steel, and (3) stirring the steel with a nonreactive gas to equalize the temperature of the molten steel in the ladle and to float out inclusions.

As described in Japanese Pat. No. 59-89708 (1984), prior attempts to introduce oxygen containing gas through a single outlet submerged lance resulted in uncontrollable turbulence in the steel ladle that produced splashing and safety hazards.

The consumable lance 4 shown in FIG. 1 is further described in copending U.S. patent application Ser. No. 07/088,449 filed Aug. 24, 1987 and comprises a plurality of parallel oxygen conduits 10 surrounding a central support member 11 and encased in a protective refractory coating 12. The consumable lance 4 is further adapted to introduce a nonreactive gas into the molten steel through the parallel oxygen conduits 10 or through a separate conduit (not shown) in the central support member. The size and number of parallel conduits used in the lance 4 will depend on the quantity and rate of introduction of the oxygen gas required. The plurality of oxygen conduits and the central support member are encased in a castable refractory 12. Anchor members may be used to bond the castable refractory to the conduits.

In one preferred embodiment of consumable lance 4, a small diameter tube (not shown) extends down the center of central support member 11 to convey a nonreactive gas, such as argon. In this embodiment, the nonreactive gas enters the molten steel at the bottom of lance 4 at substantially the same location as which the oxygen containing gas streams enter the molten steel. Alternatively, the nonreactive gas can be mixed with the oxygen containing gas at the manifold 13 and the central nonreactive gas tube eliminated.

The nonreactive gas is introduced into the molten steel through the consumable lance 4 eliminating the need for a porous brick or tuyere built into the bottom of the ladle as taught in Japanese Pat. No. 59-89708. The nonreactive gas is used to stir the molten steel in the ladle and prevent temperature stratification which would be harmful to the ladle refractories and to the quality of the steel being cast.

As indicated above, the method of this invention uses the above described apparatus to (1) ensure that sufficient oxidizable fuel is always present in the molten steel, (2) include a plurality of oxygen containing gas streams beneath the surface of the molten steel in sufficient quantities to fully react with the fuel and generate sufficient heat in the molten steel and (3) stir the molten steel with a nonreactive gas to equalize the temperature throughout the molten steel in the ladle.

Factors that affect the efficiency of our process are the oxygen rate, the total oxygen consumed, lance design, fuel type and availability, oxygen injection depth and nonreactive gas stirring procedure.

The heating rate is a linear function of the oxygen flow rate and the net temperature gain is a linear function of the total amount of oxygen consumed. Although high oxygen rates up to 20 scfm/NT (0.63 $nm^3$/min/tonne) which gave heating rates of 25°–40° F./min (14°–22° C./min) were achievable in small, pilot plant 9-ton (8.2 tonne) ladles, oxygen rates that are feasible in larger ladles are constrained by both the steel bath turbulence that can be tolerated and the oxygen rates that the oxygen flow system can deliver. Allowing for the smaller heat loss per net ton in large ladles, a goal of 10° F./min (5.6° C./min) can be attained with an oxygen blowing rate of 6 scfm/NT (0.19 $nm^3$/min/tonne). This flow rate enables a gross gain of 80° F. (44° C.), for example, in 8 minutes, which is judged necessary to realize a net gain of 50° F. (28° C.) after adding aluminum, blowing oxygen, correcting chemistry and stirring. For these steps, a total cycle time of about 35 minutes is required.

The heating rate is strongly dependent on the type of fuel being oxidized and on the availability of fuel in the steel bath. Although both aluminum and silicon are effective fuels, aluminum produces more heat per unit of oxygen and is therefore the preferred fuel. The reheat rates achieved with silicon were about 30% less per unit oxygen than with aluminum. The fuel is preferably added as a wire beneath the surface of the molten steel but can be added as lumps, rods or other physical forms with similar results. Tests were run by adding the total required aluminum before the oxygen blow and some tests were run by adding most of the aluminum during the blow. The two methods produced similar reheat rates as long as sufficient aluminum was present in the bath. It is preferred that the aluminum be added before the oxygen is added to insure that enough aluminum is always present during the oxygen blow. However, when the time for the reheat process must be minimized, a portion or all of the aluminum could be added during the blow. The amount of fuel needed is proportional to the quantity of oxygen used. A summary of the actual results on 9-NT (8.2-tonne) heats and the theoretical ratios of fuel to oxygen is as follows:

| | | Fuel/Oxygen Ratio, lb/scf | |
|---|---|---|---|
| Steel Grade | Fuel | Actual | Theory |
| >.06% C, >.40% Mn | Si | 0.0595 | 0.0719 |
| >.06% C, >.40% Mn | Al | 0.0885 | 0.0935 |
| ≦.06% C, <.40% Mn, <.03% Si | Al | 0.1124 | 0.0935 |

The lance is preferably submerged between 15% and 40% of the depth of molten steel in the ladle. Inadequate stirring with the nonreactive gas can result in temperature stratification that could be harmful to the refractory and to steel quality, while unnecessary stirring can result in the loss of valuable heat. We prefer to stir with the nonreactive gas only part of the time during which the oxygen containing gas is introduced into the molten steel.

In order to more fully illustrate the nature of our invention and the manner of practicing the same the following examples are presented.

EXAMPLE I

A 590,000 lb (268,180 kg) heat of sheet grade steel was reheated in the ladle. The temperature of the steel before reheating was 2953 F. (1623 C.) and the steel analysis was 0.04% C, 0.30% Mn, 0.007% P, 0.018% S, 0.008% Si and 0.084% Al. A four-tube lance was lowered about 5 feet (1.5 m) into the bath and a mixture of oxygen and argon was blown for 4 minutes. The lance was lowered at the rate of 6 inches/min (15.2 cm/min) during the blow and there was no splashing during the reheating. The oxygen flow rate was 1500 scfm (425 $nm^3$/min) while the argon flow rate was 4 scfm (0.1 $nm^3$/min). Aluminum wire was fed into the bath during the blow. The total aluminum fed during the blow was 450 lbs (204.5 kg). The steel temperature after the blow was 3010 F. (1654 C.) and the steel analysis was 0.04% C, 0.27% Mn, 0.007% P, 0.019% S, 0.006% Si and 0.077% Al. The temperature after a 90 second argon stir, at 9 scfm (0.25 $nm^3$/min) was 2995 F. (1646 C.) for a loss during stirring of 10 F./min (5.6 C./min). The temperature after a further 2 minute stir was 2987 F. (1642 C.) for a loss of 4 F./min (2.2 C./min) and after a further 2 minute stir was 2977 F. (1636 C.) for a loss of 5 F./min (2.8 C./min).

It was then judged that the steel temperature in the bath was equalized. The net temperature gain from the beginning of the blow until after the first argon post-stir was 42 F. (23 C.) or 10.5 F./min (5.8 C./min).

EXAMPLE II

A 590,000 lb (268,180 kg) heat of sheet grade steel was reheated in the ladle. The steel temperature after a 2 minute argon stir at 8.5 scfm (0.24 $nm^3$/min) was 2909 F. (1598 C.). The steel analysis was 0.03% C, 0.22% Mn, 0.008% P, 0.014% S, 0.001% Si and 0.064% Al. A four-tube lance was lowered about 5 feet (1.5 m) into the bath and a mixture of oxygen and argon was blown for 6 minutes. The lance was lowered at the rate of 6 inches/min (15.2 cm/min) during the blow. There was no splashing during the reheating. The oxygen flow rate was 1500 scfm (42.5 $nm^3$/min) while the argon flow rate was 4 scfm (0.1 $nm^3$/min). 870 lbs (345 Kg) of aluminum wire was fed into the bath during the blow. The steel temperature after the blow as 2975 F. (1635 C.) and the steel analysis was 0.03% C, 0.22% Mn, 0.008% P, 0.015% S, 0.001% Si and 0.045% Al. The temperature after a 2½ minute argon stir at 8 scfm (0.23 $nm^3$/min) with a separate argon lance was 2964 F. (1629 C.) for a loss of 4.4 F./min (2.4 C./min). The temperature after a further 3 minute argon stir at 8 scfm (0.23 $nm^3$/min) was 2957 F. (1625 C.) for a loss of 2.3 F./min (1.3 C./min). This temperature drop is low for this argon flow rate and the temperature in the bath was judged to be equalized. The net temperature gain from the beginning of reheating until the end of the first post argon stir was 55 F. (30.6 C.) or 9 F./min (5 C./min).

We claim:

1. A method of heating molten steel contained in an open top refractory lined ladle comprising introducing a plurality of oxygen containing gas streams beneath the surface of the molten steel to an unconfined reaction zone spaced a substantial distance from the refractory lining and introducing a quantity of an oxidizable non-carbonaceous fuel into the reaction zone sufficient so that the oxidation thereof by the oxygen containing gas steams raises the temperature of the molten steel to a predetermined level.

2. The method of claim 1 in which the oxidizable fuel contains aluminum or silicon.

3. The method of claim 1 in which the oxidizable fuel is in the form of a wire.

4. The method of claim 1 in which a nonreactive gas is mixed with the oxygen containing gas.

5. The method of claim 1 in which the oxygen containing gas is introduced at a plurality of points located between 15–40% of the depth of the molten steel in the ladle.

6. The method of claim 1 in which a nonreactive gas is introduced into the molten steel at substantially the same location as that of the oxygen containing gas streams.

7. The method of claim 1 in which the oxygen containing gas is introduced through a consumable lance whose outlet is maintained at a substantially constant depth.

* * * * *